US007905466B2

(12) United States Patent
Lee et al.

(10) Patent No.: US 7,905,466 B2
(45) Date of Patent: Mar. 15, 2011

(54) ICE TRAY

(75) Inventors: Tae Hee Lee, Seoul (KR); Hong Hee Park, Seoul (KR); Joon Hwan Oh, Seoul (KR); Young Jin Kim, Seoul (KR); Kwang Ha Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 12/142,132

(22) Filed: Jun. 19, 2008

(65) Prior Publication Data

US 2009/0020681 A1 Jan. 22, 2009

(30) Foreign Application Priority Data

Jul. 16, 2007 (KR) ..... 10-2007-0071152

(51) Int. Cl.
*F25C 1/00* (2006.01)

(52) U.S. Cl. ..... 249/120; 249/58; 249/60; 249/93; 249/139; 249/157; D15/90; 220/23.87; 220/528; 62/72; 62/344

(58) Field of Classification Search ..... 249/58, 249/60, 69–72, 76, 78, 85, 90–93, 117, 119–120, 249/127, 128, 134, 135, 139, 110, 129, 157, 249/163, 164; 220/592.15, 23.4, 23.6, 23.8, 220/23.87, 526, 530, 797, 806, 23.88, 23.89, 220/527, 528; D15/90; 62/72, 344
See application file for complete search history.

(56) References Cited

U.S. PATENT DOCUMENTS 1,740,919 A 12/1929 Copeman
2,175,324 A * 10/1939 Stamp ..... 249/92
2,389,317 A * 11/1945 Kitto ..... 62/73
2,474,936 A * 7/1949 Elliott ..... 249/120
2,498,964 A * 2/1950 Roethel ..... 249/120
2,558,984 A * 7/1951 Roethel ..... 249/120
2,588,222 A * 3/1952 Ekkebus et al. ..... 249/120
2,614,399 A * 10/1952 Roethel ..... 249/120
3,952,539 A * 4/1976 Hanson et al. ..... 62/351

(Continued)

FOREIGN PATENT DOCUMENTS

JP 05-296623 11/1993

(Continued)

OTHER PUBLICATIONS

Translation of JP 06-273014 A.*
Korean Office Action dated Mar. 19, 2008.
Korean Office Action dated Sep. 3, 2008.
International Search Report and Written Opinion of the International Searching Authority dated Oct. 29, 2009.

(Continued)

*Primary Examiner* — Joseph S Del Sole
*Assistant Examiner* — Dimple Bodawala
(74) *Attorney, Agent, or Firm* — KED & Associates, LLP

(57) ABSTRACT

An ice tray is provided that prevents the overflow or splashing of water or thin ice out of the ice tray as water is supplied to the ice tray, or when the ice tray is shaken by an external force. The ice tray may include a plurality of receiving portions that receive water for freezing into ice pieces. An overflow preventing portion may extend upward from upper edges of the receiving portions to form a barrier to water flowing out of the ice tray. Alternatively, the receiving parts may be positioned within a corresponding plurality of location parts having water proofing walls extending upward therefrom to inhibit the unintentional flow of water or thin ice out of the receiving portions of the ice tray.

21 Claims, 6 Drawing Sheets

U.S. PATENT DOCUMENTS

| | | | | |
|---|---|---|---|---|
| 4,023,768 | A * | 5/1977 | Herrera-Casasus | 249/81 |
| 4,942,742 | A * | 7/1990 | Burruel | 62/347 |
| 5,044,600 | A * | 9/1991 | Shannon | 249/121 |
| 5,364,063 | A * | 11/1994 | Nishimura et al. | 249/52 |
| 6,357,720 | B1 * | 3/2002 | Shapiro et al. | 249/119 |
| 7,051,541 | B2 * | 5/2006 | Chung et al. | 62/137 |
| 7,152,424 | B2 * | 12/2006 | Shoukyuu et al. | 62/351 |
| 7,386,993 | B2 * | 6/2008 | Castrellon et al. | 62/353 |
| 7,628,030 | B2 * | 12/2009 | Visin et al. | 62/344 |
| 2005/0066670 | A1 * | 3/2005 | Chung et al. | 62/137 |
| 2006/0117786 | A1 * | 6/2006 | Lee et al. | 62/351 |
| 2009/0235682 | A1 * | 9/2009 | Petrenko et al. | 62/351 |
| 2009/0277191 | A1 * | 11/2009 | Heger et al. | 62/66 |

FOREIGN PATENT DOCUMENTS

| | | | |
|---|---|---|---|
| JP | 06-011228 | | 1/1994 |
| JP | 06273014 | A * | 9/1994 |
| JP | 2004-309046 | | 11/2004 |
| KR | 10-1996-008175 | | 3/1996 |
| KR | 10-2007-0048166 | | 5/2007 |
| WO | WO 2008002023 | A1 * | 1/2008 |
| WO | WO 2008023899 | A1 * | 2/2008 |

OTHER PUBLICATIONS

Korean Notice of Allowance issued in Korean Application No. 10-2009-0046454 dated Aug. 26, 2010.

* cited by examiner

ICE TRAY

This application claims the benefit of Korean Patent Application No. 10-2007-0071152, filed in Korea on Jul. 16, 2007, which is hereby incorporated by reference in its entirety as if fully set forth herein.

BACKGROUND

1. Field

This relates to an ice tray, and more particularly, to an ice tray that is capable of preventing the overflow or splashing of water or thin ice out of the ice tray during the supply of water or when the ice tray is shaken by an external force.

2. Background

An ice tray typically has a structure with an interior divided into a plurality of spaces into which water is supplied and in which the water is frozen into ice. Ice trays may be mounted in an ice maker of a refrigerator or the like.

Ice trays may be classified as a heating type ice tray or as a twist type ice tray based on how the ice is separated from the ice tray. In a heating type ice tray, a heater heats the ice tray such that the outer surface of the ice in the ice tray melts and separates from the ice tray. In a twist type ice tray, the ice tray is twisted, and the ice is separated from the ice tray without the use of a heater. An ice separating system which minimizes or eliminates the flow of water and/or partially frozen, thin pieces of ice, out of the ice tray is desirable.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

An ice separating system may include an ice tray made of a conductive material. A pulse may be applied to the ice tray for a short period of time to melt the ice. The relatively short heating period may minimize water generation during melting, and may maintain the ice in a desired shape.

However, water or thin ice may splash out of or overflow from the ice tray during the supply of water into the ice tray or during the production of ice. More specifically, water may splash as it is supplied to the ice tray, or an ice maker in which the ice tray is mounted may be shaken by an external force during the production of ice, and water or thin ice may overflow from the ice tray. Consequently, this water and/or thin ice may be introduced into an ice storage box and then re-frozen into ice. This causes ice pieces stored in the storage box to stick to each other, causing difficulty in removal and use. Also, water may infiltrate and be frozen in/on peripheral components adjacent to the ice maker, thus degrading the freezing efficiency of the ice maker and the overall reliability of the system.

Figure 1:
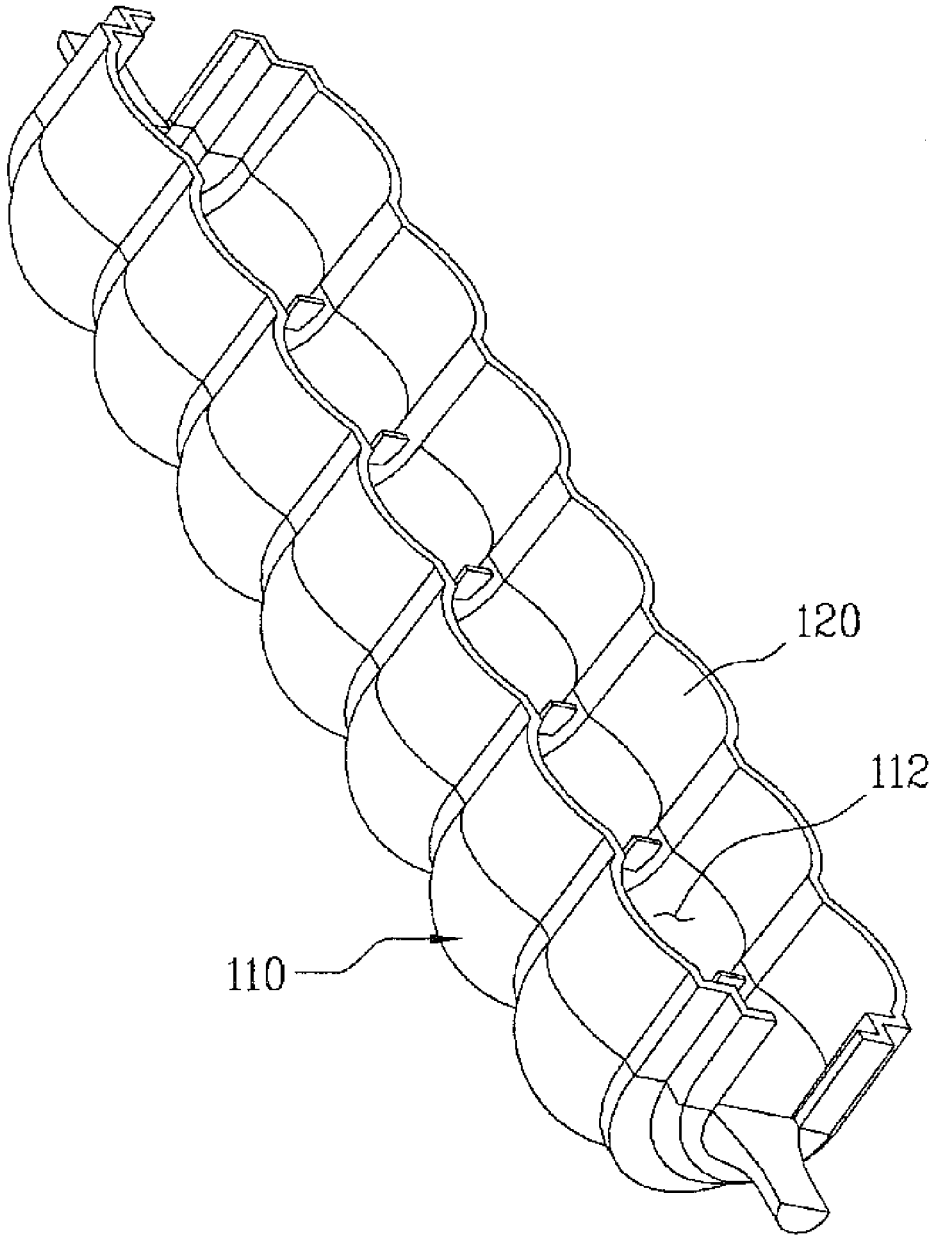
FIG. 1 is a perspective view of an ice tray according to an embodiment as broadly described herein.
Figure 2:
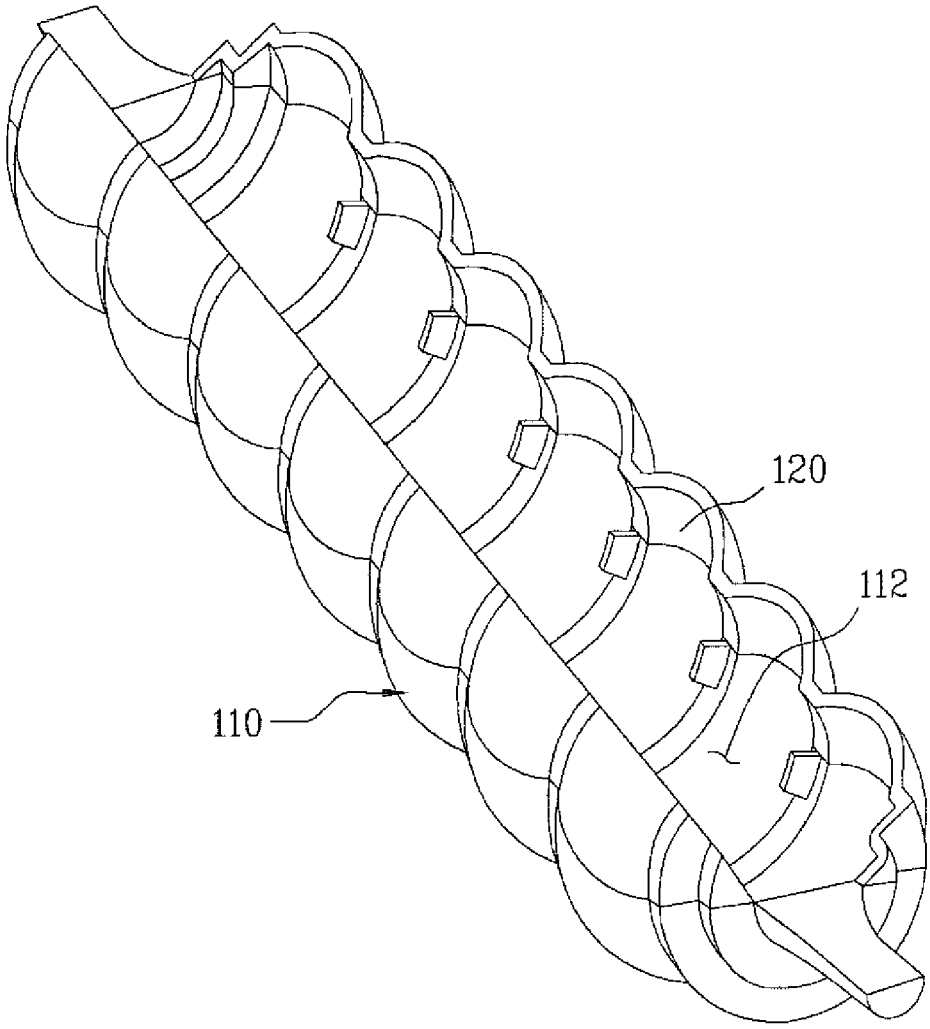
FIG. 2 is a perspective view of an ice tray according to another embodiment as broadly described herein.

Referring to FIGS. 1 and 2, an ice tray 110 as embodied and broadly described herein may include at least one receiving part 112 that receives water to produce ice. The at least one receiving part 112 may have an opening at an upper portion thereof through which water may be supplied and the ice may be discharged. A water overflow preventing member 120 may be provided to prevent the overflow or otherwise unintentional discharge of water from the at least one receiving part 112.

In certain embodiments, the ice tray 110 may include a plurality of receiving parts 112 as an assembly, as shown in FIG. 1. The ice tray 110 may be constructed such that the receiving parts 112 are arranged in a line, or in a plurality of receiving part lines, each of the receiving part lines including a plurality of receiving parts 112 arranged in a line, the receiving part lines being arranged parallel to each other. Other arrangements may also be appropriate.

The receiving parts 112 may be formed in various different shapes. For example, the receiving parts 112 may be formed in the shape of a hemisphere or a cube. The ice tray 110 may include receiving parts 112 formed in other shapes, including more complicated shapes, such as, for example, a star, a heart, or other shapes desired by a user. For ease of discussion and illustration, the receiving parts 112 shown in FIGS. 1 and 2 are formed in the shape of a hemisphere, although as discussed above, an ice tray 110 as embodied and broadly described herein may have receiving parts 112 formed in various other shapes as appropriate.

An ice tray 110 as embodied and broadly described herein may be made of a conductive material such that, when a pulse is applied to the ice tray 110, the ice is separated from the ice tray 110. In such an embodiment, the ice tray 110 may be made of a material having a high electrical conductivity, such as, for example, copper (Cu), silver (Ag), aluminum (Al), a stainless steel alloy, an aluminum alloy, or other material as appropriate. When electrodes (not shown) are connected to the ice tray 110 to construct an electric circuit, and a pulse is applied to the ice tray 110, the ice tray 110 may be uniformly heated in a short period of time.

When such a pulse is applied to the ice tray 110, the ice tray 110 is heated, the ice at an interface between the receiving parts 112 of the ice tray 110 and an outer surface of the ice is melted. As a result, a bond at the interface between the ice and the receiving part 112 is released, allowing the ice to be separated from the receiving parts 112. At this point, the ice tray 110 has already been rotated from an upright position to a downward facing position, and therefore, upon release, the ice falls from the ice tray 110 into the storage box by virtue of its own weight.

To this end, a moving part (not shown) may be provided to move the ice tray 110 to an ice separation position after the water in the ice tray 110 is frozen into ice. The moving may part rotate the ice tray 110 about a central axis that extends along a longitudinal direction of the ice tray 110 (in the direction in which the receiving parts 112 are arranged) such that the open top of each receiving part 112 of the ice tray 110 is directed downward to facilitate discharge of the ice from the receiving parts 112.

The amount of heat generated in the ice tray 110 may be controlled based on the magnitude of current supplied from a power supply (not shown) in the form of a pulse by an input controller (not shown). The input controller may include a resistance circuit, a triac circuit, a coil circuit, or other type of circuit as appropriate. In alternative embodiments, the ice tray 110 may have a twist type structure or a heating type structure including a sheath type heater, or other structure as appropriate.

As set forth above, an ice tray 110 as embodied and broadly described herein may also include a water overflow preventing member 120. The water overflow preventing member 120 may be formed in the shape of a partition wall that prevents the overflow of water (or thin ice) out of the ice tray 110 as water is supplied to the ice tray 110 or during the production of ice. The water overflow preventing member 120 may be formed integrally with the receiving parts 112, and may protrude a predetermined length above the receiving parts 112, from the upper edge of the openings.

The length of the water overflow preventing member 120, i.e., the height of the water overflow preventing member 120, may be experimentally or experientially established to prevent water overflow from the ice tray 110. For example, the height of the water overflow preventing member 120 may be between 0.5 and 3 times the height of the ice tray 110. When establishing a height of the overflow preventing member 120, a spatial restriction when the produced ice is separated from the ice tray 110 should also be considered.

As shown in FIG. 1, the water overflow preventing member 120 may protrude upward and substantially perpendicular to the plane defined by the openings. Essentially, the water overflow preventing member 120 may protrude upward by a predetermined length from the edges of the openings of the respective receiving parts. A water overflow preventing member 120 constructed as described above may improve accessibility to a water supply unit (not shown) during the supply of water, and may reduce any catching or interference when the ice is separated from the ice tray 110.

In the embodiment shown in FIG. 2, the water overflow preventing member 120 may protrude upward from the upper edge of the at least one receiving part 112 in the shape of an arc by a predetermined length such that the water overflow preventing member 120 forms a curve directed toward the inside of each receiving part 112 from the edge of the opening of each receiving part 112. In particular, when the receiving parts 112 are formed in the shape of a hemisphere, as shown in FIG. 2, the water overflow preventing member 120 may be formed in the shape of a partial sphere together with the receiving parts 112.

When the water overflow preventing member 120 is constructed as described above, the ends of the water overflow preventing member 120 may be curved such that the ends of the water overflow preventing member 120 are directed toward the inside. This allows the water overflow preventing member 120 to effectively prevent the splashing or overflow of the water from the ice tray 110.

In alternative embodiments, a first portion of the water overflow preventing member 120 may protrude upward, from a first upper edge portion of the at least one receiving part 112, perpendicular to the plane defined by the openings, from one of the side edges of the openings, and a second portion may protrude upward in the shape of an arc from a second portion of the at least one receiving part 112 at the other side edges of the openings, by combining the embodiments shown in FIGS. 1 and 2.

When the ice tray 110 is made of a conductive material and a pulse is applied to the ice tray 110 to separate the ice from the ice tray 110, the water overflow preventing member 120 may be made of a nonconductive material. Consequently, when a pulse is applied to the receiving parts 112, the current flowing through the conductive receiving parts 112 the ice tray 110 is not transferred to the non-conductive water overflow preventing member 120. Therefore, heat is supplied only to the receiving parts 112, in which the ice is received, while reducing power consumption.

In this case, the water overflow preventing member 120 may be made of a high heat-resistant material such that the receiving parts 112 are not deformed or damaged, even when the receiving parts 112 are heated. Also, the water overflow preventing member 120 may be molded together with the receiving parts 112 by double injection, or may be integrally attached to the receiving parts 112 by bonding or welding, depending upon the material selected for the water overflow preventing member 120 and the receiving parts 112.

Figure 3:
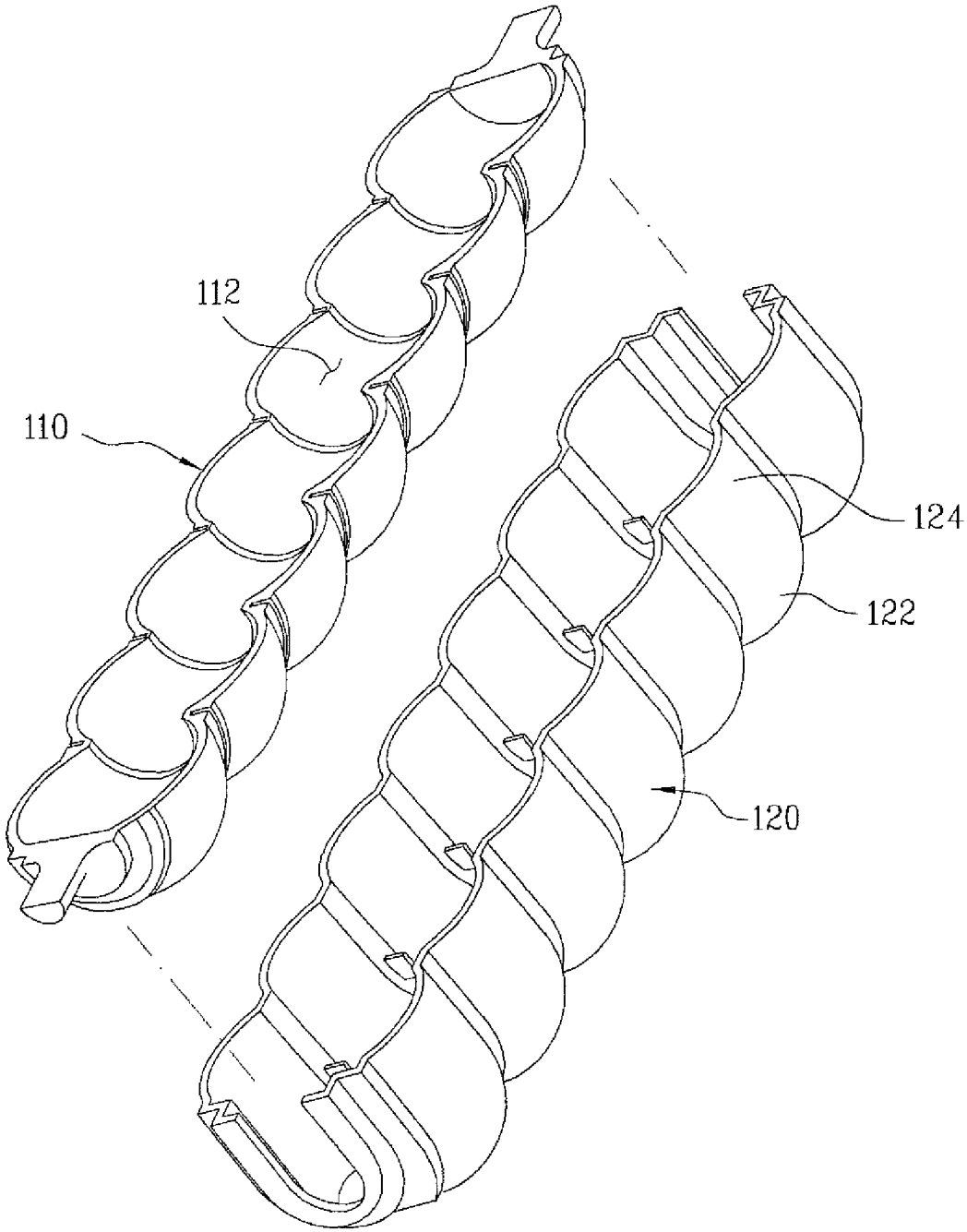
FIG. 3 is an exploded perspective view of an ice tray including a water overflow preventing member as embodied and broadly described herein.

Referring to FIGS. 3 to 6, the water overflow preventing member 120 of the ice tray 110 shown in FIG. 3 may be manufactured separately from the receiving parts 112, and then coupled to the receiving parts 112. Thus, it is possible to prevent the overflow or splashing of water from the receiving parts 112 to the outside by coupling the receiving parts 112, which may be constructed in a general shape, to a water overflow preventing member 120 manufactured separately from the receiving parts 112.

The water overflow preventing member 120 shown in FIG. 3 may include location parts 122 that support corresponding receiving parts 112, and waterproofing walls 124 that extend upward from the location parts 122 by a predetermined length and are substantially perpendicular to the plane defined by the openings when the receiving parts 112 are located in the corresponding location parts 122. In this manner, the receiving parts 112 may be supported by the corresponding location parts 122.

Figure 4:
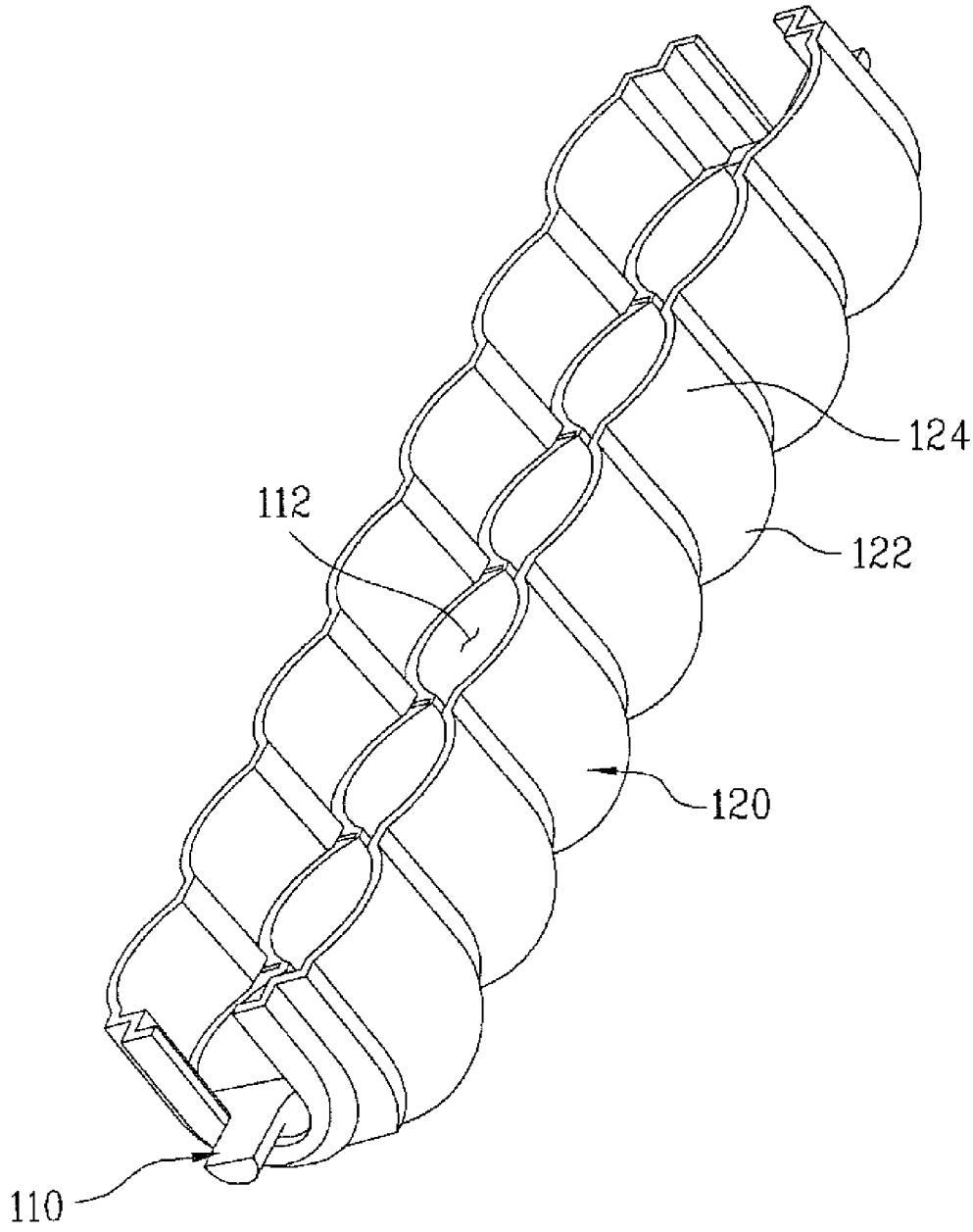
FIG. 4 is an assembled perspective view of the water overflow preventing member and receiving parts of the ice tray shown in FIG. 3.

The location parts 122 may be constructed in a shape similar to that of the receiving parts 112. The location parts 122 may have a size slightly greater than the external shape of the receiving parts 112, such that the receiving parts 112 may be tightly inserted into the corresponding location parts 122 as shown in FIG. 4.

Figure 5:
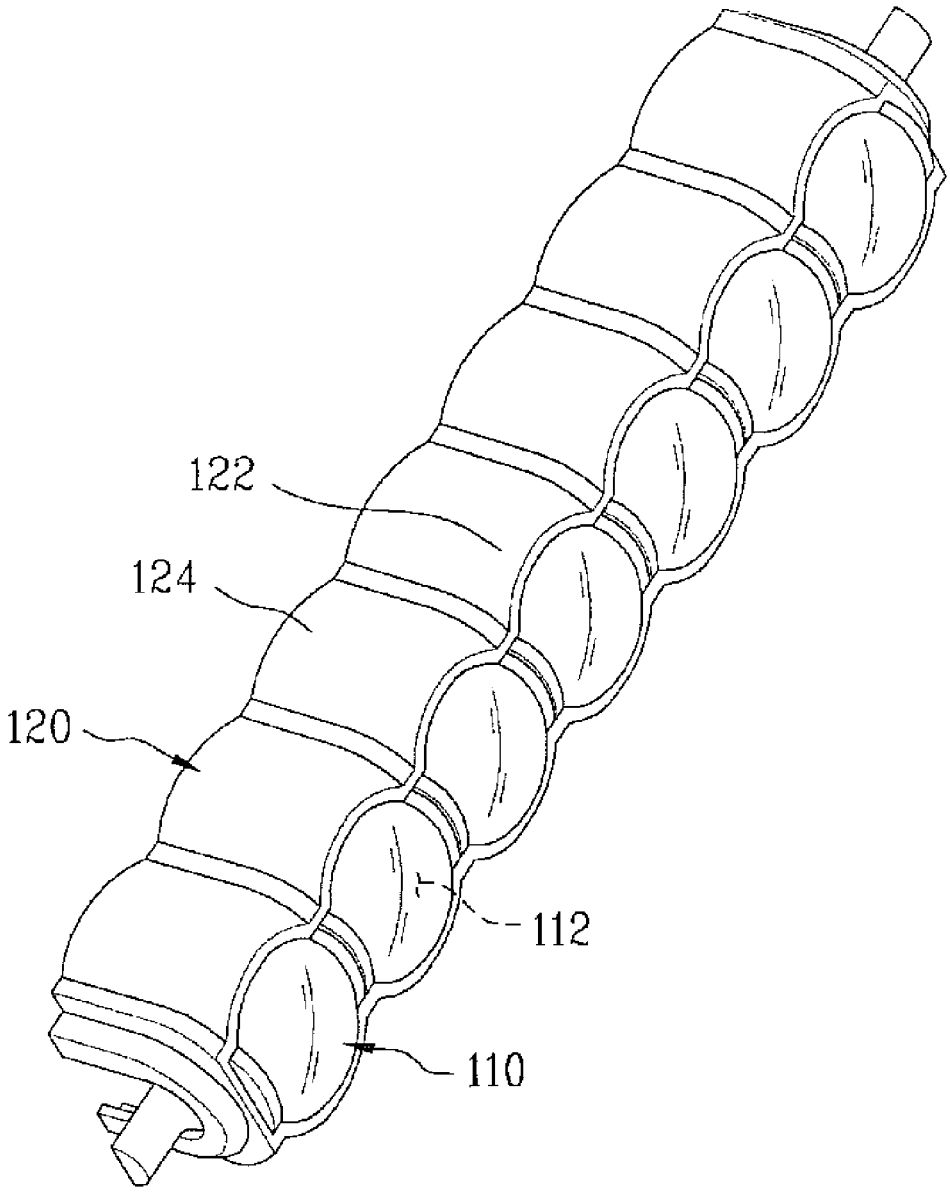
FIG. 5 is bottom perspective view of the ice tray shown in FIGS. 3 and 4.

As shown in particular in FIG. 5, a bottom portion of each location part 122 may be opened such that the bottom of each receiving part 112 protrudes downward through the opening of the corresponding location part 122. Thus, the location parts 122 do not necessarily cover entirely the outer surfaces of the corresponding receiving parts 112, but may cover predetermined upper parts of the outer surfaces of the corresponding receiving parts 112, to support the corresponding receiving parts 112 such that the receiving parts 112 do not fall.

When the ice tray 110 is made of a conductive material and a pulse is applied to the ice tray 110 to separate ice from the ice tray 110, the location parts 122 may be made of a non-conductive material. Consequently, when a pulse is applied to the conductive receiving parts 112, introduction of current to the non-conductive location parts 122 may be prevented, thereby providing uniform heat only in the receiving parts 112, in which the ice is received, while reducing power consumption. In this case, the water overflow preventing member 120 may be made of a high heat-resistant material such that the receiving parts 112 are not deformed or damaged even when the receiving parts 112 are heated, because the location parts are in contact with the corresponding receiving parts 112.

The waterproofing walls 124 may protrude upward and substantially perpendicular to the plane defined by the openings of the receiving parts 112. In certain embodiments, the waterproofing walls 124 may protrude upward from the location part 122 in the shape of an arc, curving inward toward the inside of the at least one receiving part from the corresponding location parts 122. Alternatively, one side of each waterproofing wall 124 adjacent to a first side of the opening in the at least one receiving part 112 may protrude upward from the location part 122 in a substantially straight line, and the other side of each waterproofing wall 124 adjacent to a second side of the opening in the at least one receiving part 112 may protrude upward from the location part 122 in the shape of an arc.

The location parts 122 may be made of a flexible material so that the receiving parts 112 may be brought into tight contact with the corresponding location parts 122, thereby preventing movement of the receiving parts 112 in the corresponding location parts 122. Also, the waterproofing walls 124 may be molded together with the receiving parts 112 by double injection, or may be integrally attached to the location parts 122 by bonding or welding, depending upon the material of the waterproofing walls 124 and the receiving parts 112.

Such a water overflow preventing member 120 may be coupled to the receiving parts 112 by fitting the receiving parts 112 into the water overflow preventing member 120 from above. In this case, the ice tray 110 may also include protrusions 126 provided with the location parts 122to prevent movement of the receiving parts 112 in the location parts 122, or to prevent separation of the receiving parts 112 from the location parts 122, and to support the receiving parts 112 in the corresponding location parts 122.

Figure 6:
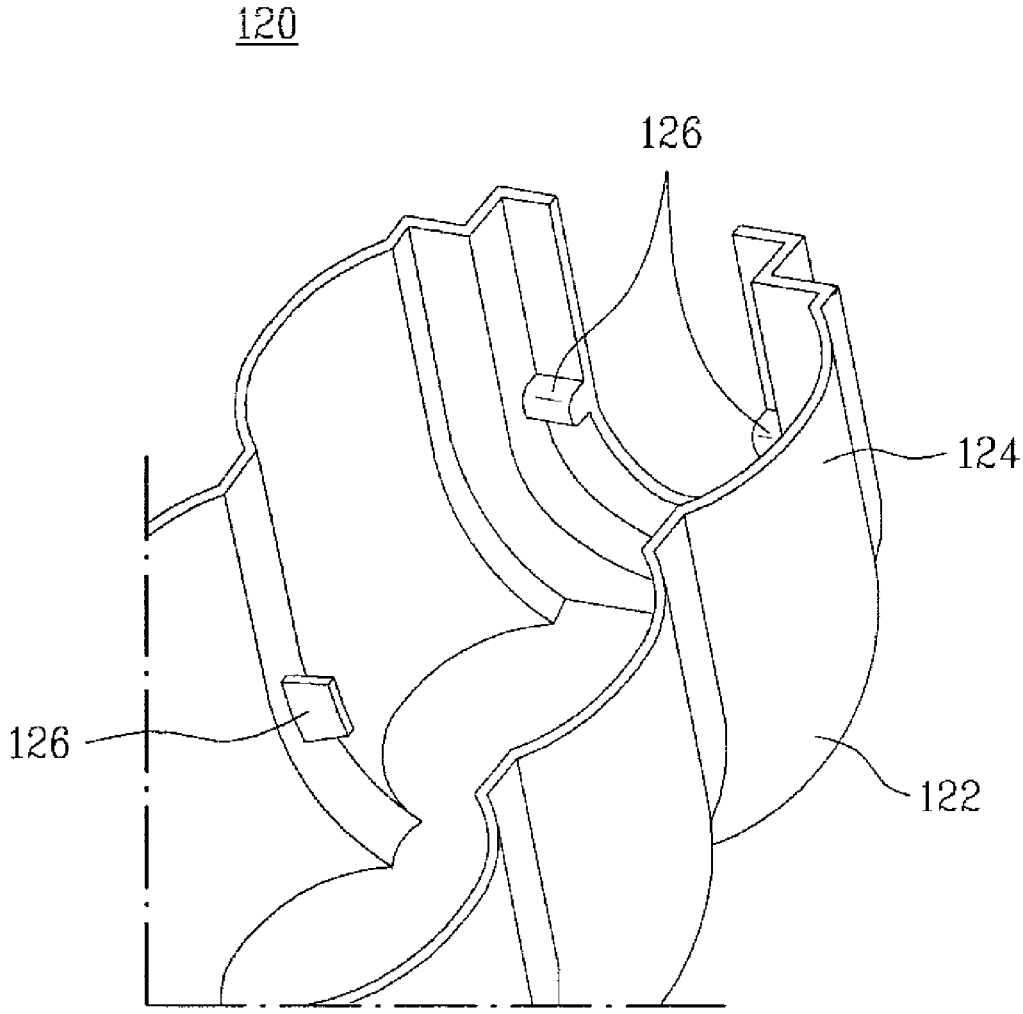
FIG. 6 is a partial perspective view of an ice tray as embodied and broadly described herein.

As shown in FIG. 6, the protrusions 126 may be provided at the borders between the respective receiving parts 112. The protrusions 126 may be made of a flexible material. Consequently, when the receiving parts 112 are coupled to the water overflow preventing member 120, the protrusions 126 may be deformed, and therefore, the coupling between the receiving parts 112 and the water overflow preventing member 120 is not disturbed by the protrusions 126. Also, the protrusions 126 may tend to press the receiving parts 112 downward, such that the receiving parts 112 may be fixed in and supported by the corresponding location parts 122.

As the location parts 122 may be made of a flexible material, the location parts 122 may be in tight contact with the corresponding receiving parts 112, and the receiving parts 112 may be fixed in the location parts 122 by the protrusions 126. Consequently, even when the ice tray 110 is rotated to separate ice from the ice tray 110, the receiving parts 112 remain fixed to the water overflow preventing member 120. Thus, separation of the receiving parts 112 from the water overflow preventing member 120, or movement of the receiving parts 112 in the water overflow preventing member 120 may be prevented.

A water overflow preventing member 120 having the above-stated construction effectively prevents the overflow or splashing of water out of the ice tray 110 during the supply of water to the ice tray 110, or when the ice tray 110 is shaken by an external force during the production of ice.

An ice tray as embodied and broadly described herein may prevent the overflow of water or thin ice from the ice tray even when water splashes during the supply of water to the ice tray, or when the ice maker in which the ice tray is mounted is shaken by an external force during the production of ice.

An ice maker as embodied and broadly described herein may prevent ice pieces from sticking to each other, thus preventing degradation in the freezing efficiency of the ice maker, overall reliability of the system. This allows a user to easily extract and use ice pieces, thereby improving the convenience of use to the user.

An ice tray is provided that is capable of preventing the overflow or splashing of water or thin ice to the outside during the supply of water or when the ice tray is shaken by an external force.

An ice tray as embodied and broadly described herein may include at least one receiving part for receiving water necessary to produce ice, the at least one receiving part being provided at the top thereof with an opening, through which the water is supplied and the ice is separated, and a water overflow preventing member for preventing the overflow or splashing of water or thin ice from the at least one receiving part.

The at least one receiving part may be formed in the shape of a hemisphere or a cube.

The water overflow preventing member may be integrally formed with the at least one receiving part, and the water overflow preventing member may protrude upward by a predetermined length from the edge of the opening.

The water overflow preventing member may protrude upward such that the water overflow preventing member is perpendicular to the plane defined by the opening, or the water overflow preventing member may protrude upward in the shape of an arc. Alternatively, the water overflow preventing member may protrude upward such that the water overflow preventing member is perpendicular to the plane defined by the opening from one-side edge of the opening, and the water overflow preventing member may protrude upward such that the water overflow preventing member is formed in the shape of an arc from the other-side edge of the opening.

The water overflow preventing member may be manufactured separately from the at least one receiving part, and may then coupled to the at least one receiving part.

The water overflow preventing member may include a location part for supporting the at least one receiving part, and a waterproofing wall connected to the location part and protruding upward by a predetermined length such that the waterproofing wall is perpendicular to the plane defined by the opening adjacent to the edge of the opening when the at least one receiving part is located in the location part such that the at least one receiving part is supported by the location part.

The ice tray may also include a protrusion mounted at the location part for preventing the movement of the least one receiving part in the location part or the separation of the least one receiving part from the location part when the at least one receiving part is located in the location part such that the at least one receiving part is supported by the location part.

The location part is made of a flexible material, whereby the location part is in tight contact with the at least one receiving part to support the at least one receiving part.

A ice tray as embodied and broadly described herein may include at least one receiving part for receiving water necessary to produce ice, the at least one receiving part being provided at the top thereof with an opening, through which the water is supplied and the ice is separated, a location part for supporting the at least one receiving part, and a waterproofing wall connected to the location part and protruding upward by a predetermined length such that the waterproofing wall is perpendicular to the plane defined by the opening adjacent to the edge of the opening when the at least one receiving part is located in the location part such that the at least one receiving part is supported by the location part.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice tray, comprising:

at least one receiving part that receives water for freezing into ice, the at least one receiving part having an opening provided at a top portion thereof through which the water is supplied and the ice is discharged from the at least one receiving part; and an overflow preventing member surrounding to the at least one receiving part, wherein the overflow preventing member extends upward beyond an upper edge of the at least one receiving part that defines the opening, along two opposite longitudinal sides of the opening, so as to prevent discharge of water from the at least one receiving part.

2. The ice tray of claim 1, wherein the at least one receiving part is formed in the shape of a hemisphere or a cube.

3. The ice tray of claim 1, wherein the overflow preventing member is integrally formed with the at least one receiving part, and wherein the overflow preventing member extends upward by a predetermined length from the upper edge of the at least one receiving part that defines the opening.

4. The ice tray of claim 3, wherein the overflow preventing member extends upward from the upper edge of the at least one receiving part and is substantially perpendicular to a plane defined by the opening.

5. The ice tray according to claim 3, wherein the overflow preventing member extends upward from the upper edge of the at least one receiving part in the shape of an arc that extends toward an inside of the at least one receiving part.

6. The ice tray of claim 3, wherein a first portion of the overflow preventing member extends upward from a first upper edge portion of the opening of the at least one receiving part on a first of the two opposite longitudinal sides of the opening and is substantially perpendicular to a plane defined by the opening, and a second portion of the overflow preventing member extends upward from a second upper edge portion of the opening of the at least one receiving part on a second side of the two opposite longitudinal sides of the opening in the shape of an arc that extends toward an inside of the at least one receiving part.

7. The ice tray of claim 1, wherein the overflow preventing member is a separate part from the at least one receiving part, and the overflow preventing member is coupled to the at least one receiving part.

8. The ice tray of claim 7, wherein the overflow preventing member includes:

a location part that supports the at least one receiving part; and a waterproofing wall that extends upward from the location part in the shape of an arc that extends toward an inside of the at least one receiving part positioned in the location part.

9. The ice tray of claim 8, further comprising at least one protrusion provided with the location part, wherein the at least one protrusion secures the least one receiving part in the location part when the at least one receiving part is positioned in the location part.

10. The ice tray of claim 7, wherein the overflow preventing member includes:

a location part that supports the at least one receiving part; and a waterproofing wall that extends upward from the location part by a predetermined length such that the waterproofing wall is substantially perpendicular to a plane defined by the opening in the at least one receiving part when the at least one receiving part is positioned in the location part.

11. The ice tray of claim 10, wherein a shape of a bottom portion of the location part corresponds to a shape of the at least one receiving part so as to securely couple the at least one receiving part and the location part.

12. The ice tray of claim 10, wherein a bottom portion of the location part is open such that a bottom portion of the at least one receiving part extends partially therethrough so as to securely couple the at least one receiving part and the location part.

13. The ice tray of claim 10, further comprising at least one protrusion provided with the location part, wherein the at least one protrusion secures the at least one receiving part in the location part when the at least one receiving part is positioned in the location part.

14. The ice tray of claim 10, wherein the location part is made of a flexible material such that the location part maintains tight contact with the at least one receiving part.

15. An ice tray, comprising:

at least one receiving part that receives water to produce ice, the at least one receiving part having a top edge that defines an opening through which water is supplied to the at least one receiving part and produced ice is discharged from the at least one receiving part; an overflow preventing member surrounding the at least one receiving part, wherein the overflow preventing member comprises:

a location part coupled to the at least one receiving part; and a waterproofing wall that extends upward from the location part by a predetermined length along at least two opposite longitudinal sides of the opening in the at least one receiving part, the waterproofing wall having a first portion thereof that is positioned adjacent to the top edge of the opening in the at least one receiving part and that extends substantially perpendicular to a plane defined by the opening when the at least one receiving part is positioned in the location part.

16. The ice tray of claim 15, wherein a height of the waterproofing wall is greater than or equal to half a height of the at least one receiving part, and less than or equal to three times the height of the at least one receiving part.

17. The ice tray according to claim 15, wherein a second portion of the waterproofing wall extends upward in the shape of an arc from the first portion of the waterproofing wall.

18. The ice tray of claim 15, wherein a first side of the waterproofing wall that is adjacent to a first of the at least two opposite longitudinal sides of the opening in the at least one receiving part extends upward from the location part and is substantially perpendicular to the plane defined by the opening, and a second side of the waterproofing wall that is adjacent to a second of the at least two opposite longitudinal sides of the opening in the at least one receiving part extends upward from the location part in the shape of an arc.

19. The ice tray of claim 15, wherein a bottom portion of the location part is open so as to receive a corresponding bottom portion of the at least one receiving part partially therethrough to secure the at least one receiving part to the location part.

20. The ice tray of claim 15, wherein a shape of a bottom portion of the location part corresponds to a shape of a bottom portion of the at least one receiving part so as to secure the at least one receiving part to the location part.

21. An ice tray, comprising:

at least one receiving part that receives water for freezing into ice, the at least one receiving part having an opening provided at a top portion thereof through which the water is supplied and the ice is discharged from the at least one receiving part; and an overflow preventing member surrounding to the at least one receiving part, wherein the overflow preventing member prevents the discharge of water from the at least one receiving part, wherein the overflow preventing member includes:

a location part that supports the at least one receiving part; and a waterproofing wall that extends upward from the location part in the shape of an arc that extends toward an inside of the at least one receiving part positioned in the location part.

* * * * *